US008286297B1

(12) United States Patent
Murray

(10) Patent No.: US 8,286,297 B1
(45) **Date of Patent: *Oct. 16, 2012**

(54) HAND HELD BUILDING TOOLS

(75) Inventor: Scott A. Murray, Lenexa, KS (US)

(73) Assignee: Exceptional IP Holdings, LLC, Cary, NC (US)

( * ) Notice: Subject to any disclaimer, the term of this patent is extended or adjusted under 35 U.S.C. 154(b) by 34 days.

This patent is subject to a terminal disclaimer.

(21) Appl. No.: 12/837,707

(22) Filed: Jul. 16, 2010

Related U.S. Application Data

(63) Continuation of application No. 11/371,388, filed on Mar. 9, 2006, now Pat. No. 7,784,143.

(60) Provisional application No. 60/660,460, filed on Mar. 11, 2005.

(51) Int. Cl.
*E04F 21/16* (2006.01)
*B05C 17/10* (2006.01)

(52) U.S. Cl. ..... 15/235.4; 15/235.6; 15/236.01; 15/236.08; 15/245.1; 30/169; 148/588; 148/639

(58) Field of Classification Search ..... 15/235.4, 15/235.6, 236.01, 236.05, 236.08, 245.1; 148/588, 639; 30/169; 407/118, 119
See application file for complete search history.

(56) References Cited

U.S. PATENT DOCUMENTS

| | | | | |
|---|---|---|---|---|
| 1,352,140 | A | 9/1920 | Napier | 83/835 |
| 2,306,187 | A | 12/1942 | Ronan | 83/835 |
| 2,326,674 | A | 8/1943 | Pavitt | 148/573 |
| 2,327,129 | A | 8/1943 | Ronan | 148/588 |
| 2,395,186 | A | 2/1946 | Jones | 15/235.6 |
| 2,829,684 | A | 4/1958 | Lagerstrom | 83/852 |
| 3,136,056 | A * | 6/1964 | Reynier | 30/47 |
| 4,285,124 | A * | 8/1981 | Diakonov | 30/34.1 |
| 4,860,452 | A | 8/1989 | Guarnaccia et al. | 30/346.6 |
| 6,134,743 | A | 10/2000 | Schmidt | 15/236.01 |
| 6,568,087 | B1 | 5/2003 | Gringer | 30/169 |
| 2005/0217050 | A1 | 10/2005 | Meyers | 15/235.4 |

FOREIGN PATENT DOCUMENTS

| | | |
|---|---|---|
| CH | 687182 | 10/1996 |
| DE | 29913825 | 11/1999 |
| JP | 59-50120 | 3/1984 |

* cited by examiner

*Primary Examiner* — Mark Spisich
(74) *Attorney, Agent, or Firm* — Wolff Law Offices, PLLC; Kevin Alan Wolff

(57) ABSTRACT

The present invention is directed generally to tools that are made, at least in part, more durable, particularly one or more working surface(s) of the tools. For example, various tools such as trowels, knives, and scrappers may be made having at least a portion of their blades heat treated to make at least their working edges more durable and extend their useful lives. For example, in various embodiments, a putty knife, taping knife, or scrapper blade may have at least one working surface or edge that has been at heat treated while an area of the blade where a handle is permanently attached is not heat treated.

20 Claims, 14 Drawing Sheets

HAND HELD BUILDING TOOLS

This patent application claims priority to, and is a continuation of, U.S. patent application Ser. No. 11/371,388, filed on Mar. 9, 2006 now U.S. Pat. No. 7,784,143, which claims benefit of U.S. Provisional Patent Application No. 60/660,460, filed Mar. 11, 2005. These prior patent applications are hereby incorporated herein by reference for all purposes.

FIELD OF THE INVENTION

The present invention pertains to methods and various apparatus for building tools. For example, the invention involves methods and various apparatus for high quality durable building tools.

BACKGROUND

Various building tools have been known in the past for applying, molding, smoothing, and/or texturing material of a working surface with, for example, cement, adhesive, etc. to build, for example, a building. One particular type of building tool for applying, molding, smoothing and/or texturing materials is known as the trowel. Some types of trowels include, for example, a finishing trowel, a swimming pool trowel, and notched trowels of various kinds. These trowels are typically comprised of a blade that contacts the working surface and a handle attached to the blade for a person to grab and move the blade around on a working surface. The trowel blades have various different shapes that are designed for various applications (type of work). During use, the trowel may be used or moved at an angle relative to the working surface so that the outer edges of the trowel experiences friction and wear, such that the trowel edge may become worn out and no longer retain its original shape. Further, if the trowel is dropped the outer edges of the trowel blade may be bent so that in use the trowel does not make the desired working surface shape or result. Therefore, trowel blade durability is an important characteristic for determining the useful life of a trowel, and the durability of the outer edges of the trowel is particularly important.

SUMMARY

The present invention is directed generally to building tools that are high quality, durable, and strong. For example, various tools that have blades made of a material such as metal that wear through use may have the blades, or portions thereof, that are manufactured to be more durable and have a longer lasting useful life. For example, portions of the blades may be heat treated and cooled so as to harden or strengthen them for improved quality, durability, and strength performance. The invention is particularly useful for building more durable tools that have thin or flat blades. Such tools may include, for example, tools for the building trades including trowels, knives, and scrappers. In one embodiment, a texturing trowel may have one or more portions of its blade heat treated to improve the quality, durability, and strength performance. In one variation, the texturing trowel may have at least a first texturing edge or side of trowel blade heat treated to reduce blade wear or damage so that the quality, durability, and strength of the texturing edge is increased. In another variation, the texturing trowel may have at least a first texturing edge and a second texturing edge that are heat treated for reduced blade wear or damage, the first texturing edge and second texturing edge may be locate on opposite sides of the blade. The texturing edge may be in the shape of, for example, a square notch (or square tooth), a V notch (or triangle tooth), a rounded tooth with a semi-circle or square notch (semi-circle tooth), etc. In one variation, the blade may have various texturing edges of different shapes so that one texturing edge is a different shape than another texturing edge. In another variation, the entire blade may be heat treated and cooled.

In another embodiment, the tool may be, for example, a finishing trowel having one or more portions of the blade heat treated and cooled to harden or strengthen it. For example, the working edges of the finishing trowel blade may be flat, smooth and/or non-texturing edges that are heat treated and cooled to harden or strengthen the edge(s) so as to reduce blade wear or damage so that the quality, durability, and strength of the working edge is increased. In a still further embodiment, the tool may be, for example, a swimming pool trowel having one or more portions of the blade heat treated and cooled to harden or strengthen the blade where desired. For example, the working edges, that may include rounded ends of the trowel blade, may be heat treated and cooled to harden or strengthen the edge(s) so as to reduce blade wear or damage so that the quality, durability, and strength of the working edge is increased. In variations, the working edges of the swimming pool trowel may include texturing, may be rounded, and may be heat treated and cooled. Of course, the heating and cooling process of the present invention for hardening or strengthening blades may also be applied to other tools, for example, putty knifes, paint scrappers, notched margin trowels (V and/or square notches), notched taping knifes, brick trowels, pointing trowels, margin trowels, etc.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

The present invention is directed generally to tools that are high quality, stronger, and more durable. As such, the present invention includes various embodiments showing methods and apparatus for building tools that may be, at least in part, made of a material that is heat treated and cooled so as to make its working surface more durable and longer lasting. For example, various tools that have blades made of a material such as metal that wear through use may have the blades, or portions thereof, that are heat treated and cooled so as to harden or strengthen them for improved quality, durability, and strength performance. The invention is particularly useful for building tools with thin or flat blades with edges that will wear through use. The invention is also particularly beneficial to building tools having a texturing surface that is more likely to wear out and lose its original shape.

Figure 1:
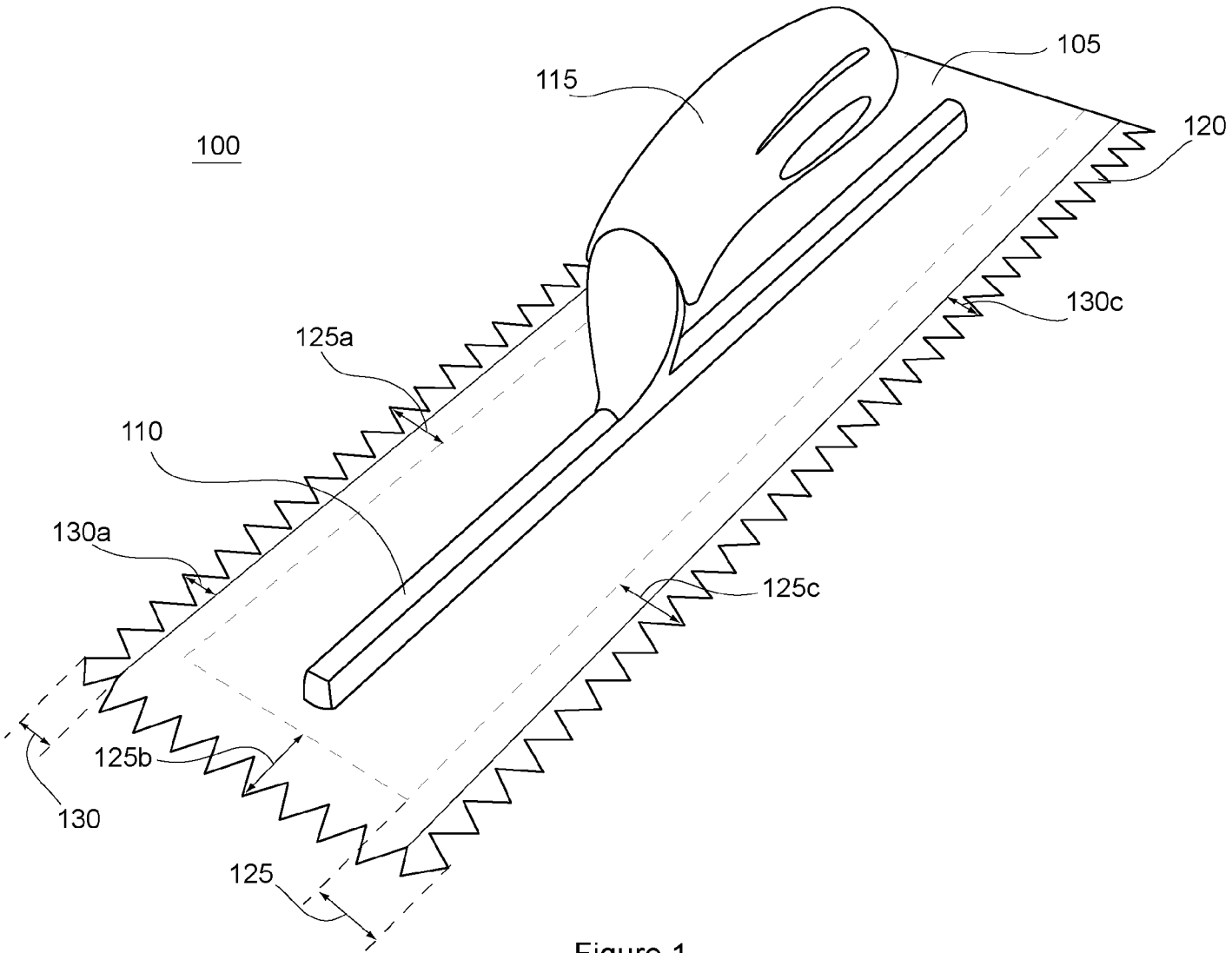
FIG. 1 illustrates a perspective view of a first texturing trowel, according to at least one embodiment of the invention.
Figure 2:
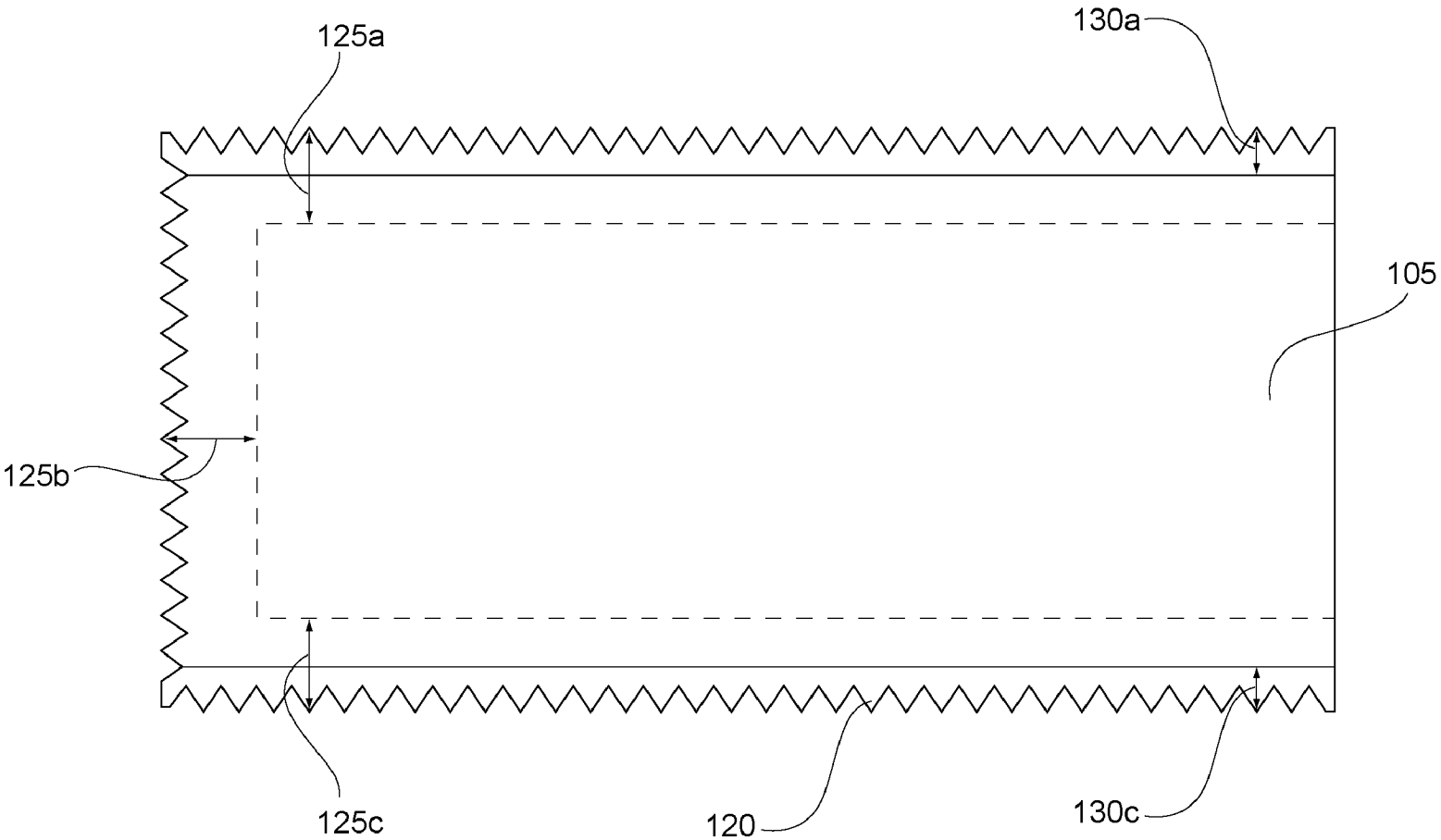
FIG. 2 illustrates a top view of the blade of the texturing trowel shown in FIG. 1, according to at least one embodiment of the invention.
Figure 3:
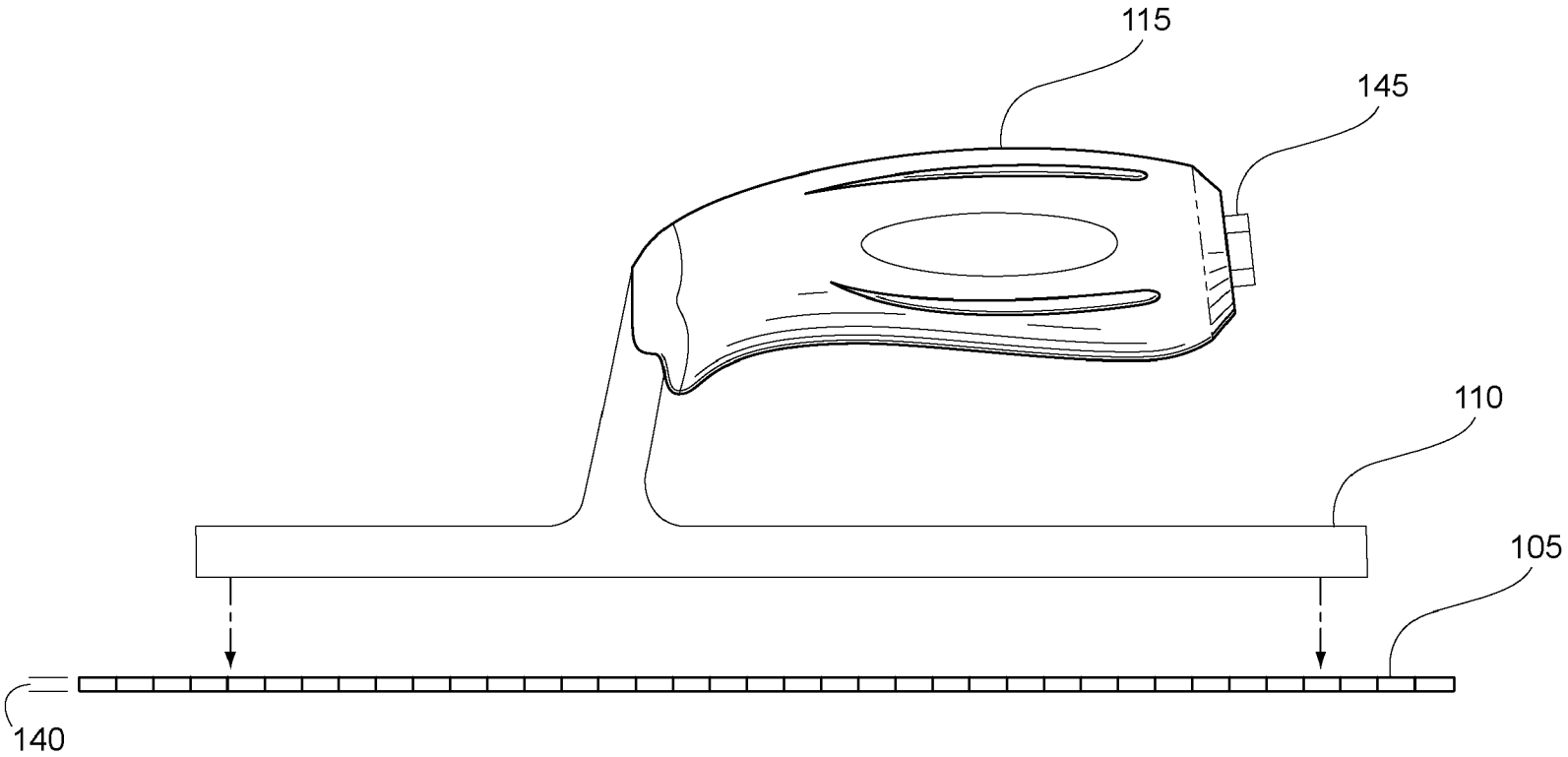
FIG. 3 illustrates a side view of the blade and handle of the texturing trowel shown in FIG. 1 prior to assembly together, according to at least one embodiment of the invention.

Referring to FIGS. 1-3, a texturing trowel 100 according to one embodiment of the invention is presented. The texturing trowel 100 may be a V notch trowel used to apply, for example, a cement or adhesive, to a building surface. The V notch trowel may include a blade 105 that may be made of a metal, for example, high carbon steel or other material suitable for acting as a blade 105 of the V notch trowel. The high carbon steel may be of a type ranging between, for example, AISI 1060 high carbon steel and AISI 1095 high carbon steel, which may be a rolled steel sheet that may be cut, punched, or machined to the size of the blade 105. The AISI 1060 Steel may be an alloy including by weight percentage; C of 0.55-0.66, Fe of 98.35-98.85, Mn of 0.6-0.9, P of a maximum 0.04, and S of a maximum 0.05. The AISI 1095 steel may be an alloy including by weight percentage; C of 0.9-1.03, Fe of 98.35-98.8, Mn of 0.3-0.5, P of a maximum 0.04, and S of a maximum 0.05. The blade 105 may be relatively thin, having a thickness 140 that may be, for example, in the range of 1/16 to 1/64 an inch. The V notch trowel 100 may have a tang 110 made of a metal, for example aluminum, that is coupled to the blade 105 by, for example, welding, brazing, etc. A handle 115 made of, for example, wood, plastic, and/or rubber, may be couple to the tang using, for example a threaded nut 145, bolt, etc. In this case, the trowel is a V notch trowel 100 and thus may have teeth, for example, teeth 120, along one or more of its blade edges. In this case, the V notch trowel blade has teeth 120 along three of its four sides. There may be many different notch sizes that may result in many different total numbers of teeth on one or more sides of the trowel.

In use, the V notch trowel 100 may be placed at an angle, for example, a 45 degree angle relative to the working surface so that the teeth 120 may contact the working surface only at their points or apex. Used in this manner for spreading, for example, cement or adhesive, the working surface and the cement or adhesive have a textured material shaped in the shape of the V notch or grooves of the trowel. However, due to the friction of the teeth on the working surface or materials being spread on the working surface, the teeth, especially the points of the teeth may be worn down over time resulting in a thinner texturing than desired. As a result, the trowel 100 would need to be reworked or replaced by a new trowel. To overcome this problem, at least a portion of the outer edges of the V notch trowel, e.g. the outer portion 130 including the teeth 120 may be heat treated and cooled so as to produce a hardened portion of the blade that is more resistant to wear during extensive use. Although the entire blade 105 may be heat treated and cooled to increase the hardness, strength and durability of the outer portion of the teeth 120, testing has shown that in some cases heat treating the entire blade may result in a blade that is too brittle and breaks more easily if dropped, during the assembly process, for example, when attaching the tang 110 or handle 115 to the blade 105, or under the pressure applied during repeated use. However, proper selection of the material used to make the blade 105 and the method used in heat treating the blade 105 may help to reduce or solve this problem. In any case, the teeth 120 are harder, stronger and more durable and may last longer within the desired height tolerance, for example up to 3 to 5 times longer.

In this embodiment, the heat treatment may be performed on, for example, the two longest sides so as to heat treat and harden only the two primary working edges of the trowel 100. As shown more clearly in FIG. 2, the heat treatment may be performed on narrow areas, for example, areas 130*a* and 130*c* (width distance from the tip of the tooth 120 to the solid line) running along the length of the trowel blade 105. Selecting to heat treat only two edge areas 130*a* and 130*c* may help to protect the most often used edges of the trowel and minimize the setup time and complexity for heat treating the desired portions of the trowel. Although in this case the distance 130*a* and 130*c* is shown to be greater than the height of the teeth 120, the distance 130*a* and 130*c* may be less than the height of the teeth 120 as will be illustrated more clearly in a later described embodiment. The distances from the tip of the teeth 120 to the dotted lines 125*a* and 125*c* indicate areas where the trowel blade 105 may be cleaned prior to the heat treating process as described in more detail below. In one variation, the front edge (the b side) and/or the back flat edge (the d side) of the blade 105 may be cleaned (e.g., area 125*b*) and the heat treated 130*b* (not shown).

Figure 4:
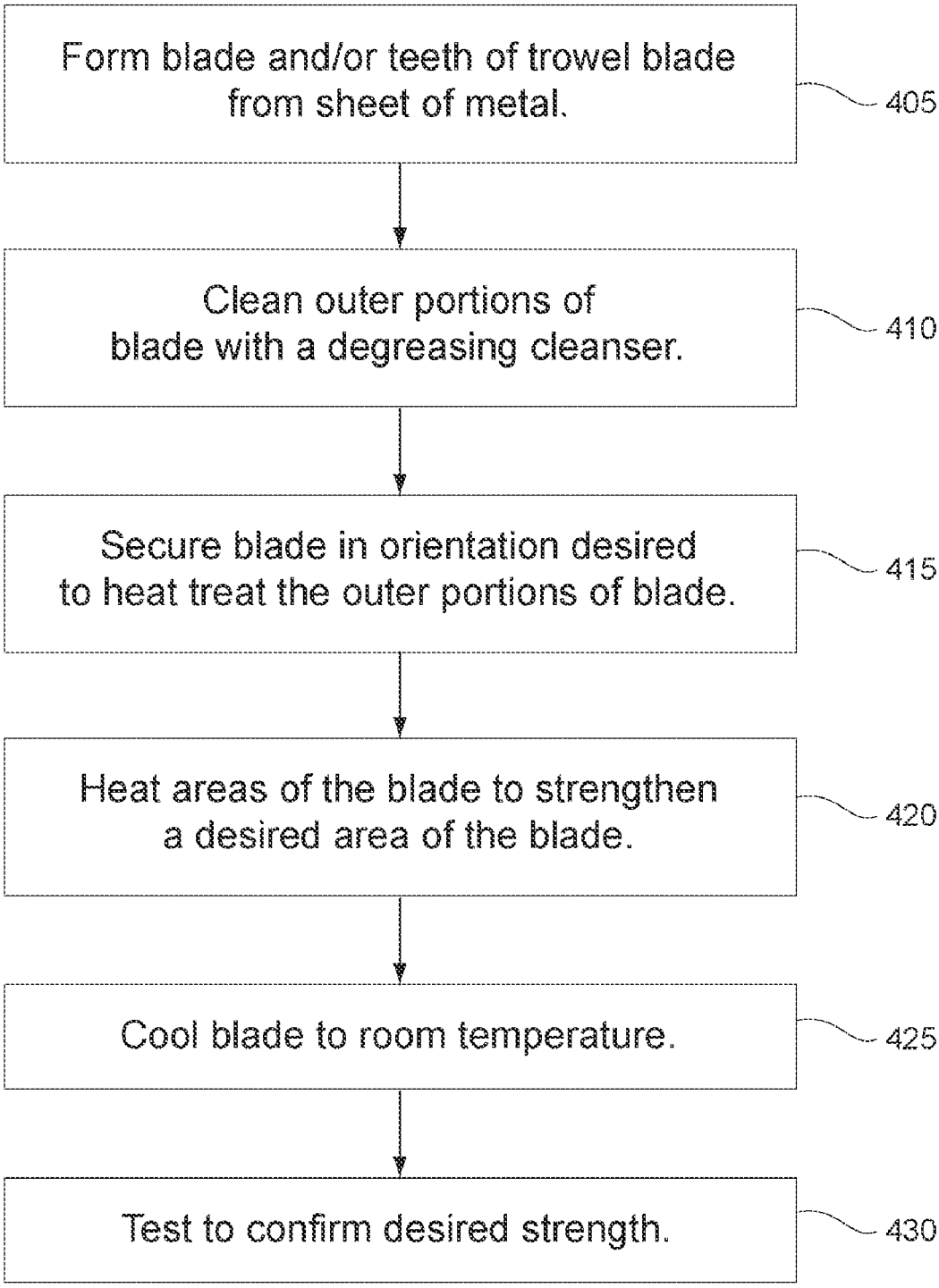
FIG. 4 is a flow chart of a process for making a heated treated tool, according to at least one embodiment of the invention.

Referring to FIG. 4, a flow chart of a process for making a heated treated tool according to at least one embodiment of the invention is provided. First, at 405 a blade with or without notches or teeth is formed from a sheet of material, for example, a metal sheet. As mentioned above, the metal may be a high carbon steel such as AISI 1060 steel or AISI 1095 steel to name a few. The shape of the blade may be formed by, for example, stamping, cutting, forming, grinding, etc. Next, at 410, at least an outer portion of the blade may be cleaned with a degreasing cleanser. The degreasing cleanser may be an alcohol base cleanser that removes dirt and grease to improve the possibility that the heat treating process may be capable of achieving a consistently higher hardness and strength of the material. Although the entire blade 105 may be cleaner at this step, for greater efficiency and lower cost, the area cleaned may be, for example, up to ½ an inch further into the blade than the area to be heat treated, e.g., the distance 125 to be degreased may be greater than the distance 130 to be heat treated. In any case, at least the area to be heat treated should be cleaned, i.e., at least a portion of the outer edge or working edge of the trowel. Next, at 415, the blade 105 may be placed in a blade transporting and/or blade holding equipment and secured in an orientation desired for heating the targeted portion of the blade 105. For example, the blade 105 may be held with a pneumatic clamp or other clamping device that allows the area 130*a* and 130*c* to be heat treated to remain exposed and may shield the rest of the blade 105 from the heat treatment. The blade 105 may be held in, for example, a parallel orientation to the heat treatment equipment that is located along either side (a and c) of the blade 105 so that both sides of the blade 105 may be treated simultaneously.

Next, at 420, at least a portion of the blade 105, for example, areas 130*a* and 130*b*, are heated to a desired temperature to harden and strengthen the edge portions and/or teeth 120. The heat treatment equipment may be, for example, an electric induction heating machine, a furnace, etc, that can heat at least a portion of the blade 105 up to the desired temperature. In the case of an electric induction heating hardening is done by heating the metal with a high frequency alternating magnetic field. Heat is generated by high frequency eddy currents and hysteresis currents on the outer surfaces to be hardened. The primary current may be carried by a water cooled copper electrode. The part to be hardened typically serves as the second electrode in the circuit. Induction heat treating is very fast. Induction hardening of trowel teeth may be accomplished by having the blade 105 stationary and activating the heat treatment equipment for a short period of time or by moving the blade 105 at the appropriate speed on, for example, a conveyor belt through the location where the heat treatment equipment is located. It is understood that those skilled in the art of induction heat treating will know that the range of operating frequency, heating temperature achieved, exposure time at temperature, and cooling rate will vary based on the type of material used to make the blade 105 (e.g., high carbon steel ranging from 1060-1095 steel), the original hardness of the material, the desired final hardness, and the specific geometry for the portions of the blade 105 that are being heat treated, e.g., the edges of the blade. Then at 425, the blade 105 may be cooled to, for example, room temperature and/or ambient temperature rapidly as through, for example, water cooling. Room temperature may vary in a range of, for example, approximately 5 degrees C. to 36 C, depending on the season and/or conditions in the heat treating facility. Alternatively, the blade could be cooled to ambient or room temperature in a controlled temperature chamber to achieve different hardness and/or strength. Further, the blade may be exposed to a second heating and cooling cycle to temper the heat treated portion of the blade. Then at 430, a confirmatory test may be performed on the edge or teeth to ensure that the proper hardness has been achieved by the heat treatment. For example, the target hardness may be in a range of approximately 57 to 61 HRC when using, for example, a heat treated blade 105 made of high carbon steel 1095. An untreated blade 105 made of high carbon steel 1095 may have a hardness target or, for example, 44-47 HRC. Other materials may result in different pre and post heat treating target hardness. The result is a blade that is harder, stronger and more durable, having a longer expected life.

After testing, as illustrated in FIG. 3, the tang 110 and handle 115 may be attached to the blade 105 by, for example, welding, brazing, screws, or any other attachment means that is available. Of course, the heat treating may be performed with the tang 110 and handle 115 already attached to the blade 105. Although, this may complicate the manufacturing process or adversely affect the coupling between the blade 105 and tang 110. In general, it is simpler and easier to heat treat the blade 105 prior to assembly with the tang 110 and handle 115. This process may be applicable regardless of the type or style of blade 105 that is used. Although the process has been described as being applied to an example where two edges of the blade 105 are heat treated, one, two, three, four, or any number of edges, portions or the entire blade 105 may be heat treated to increase its hardness, strength and durability of the desired areas.

Figure 5:
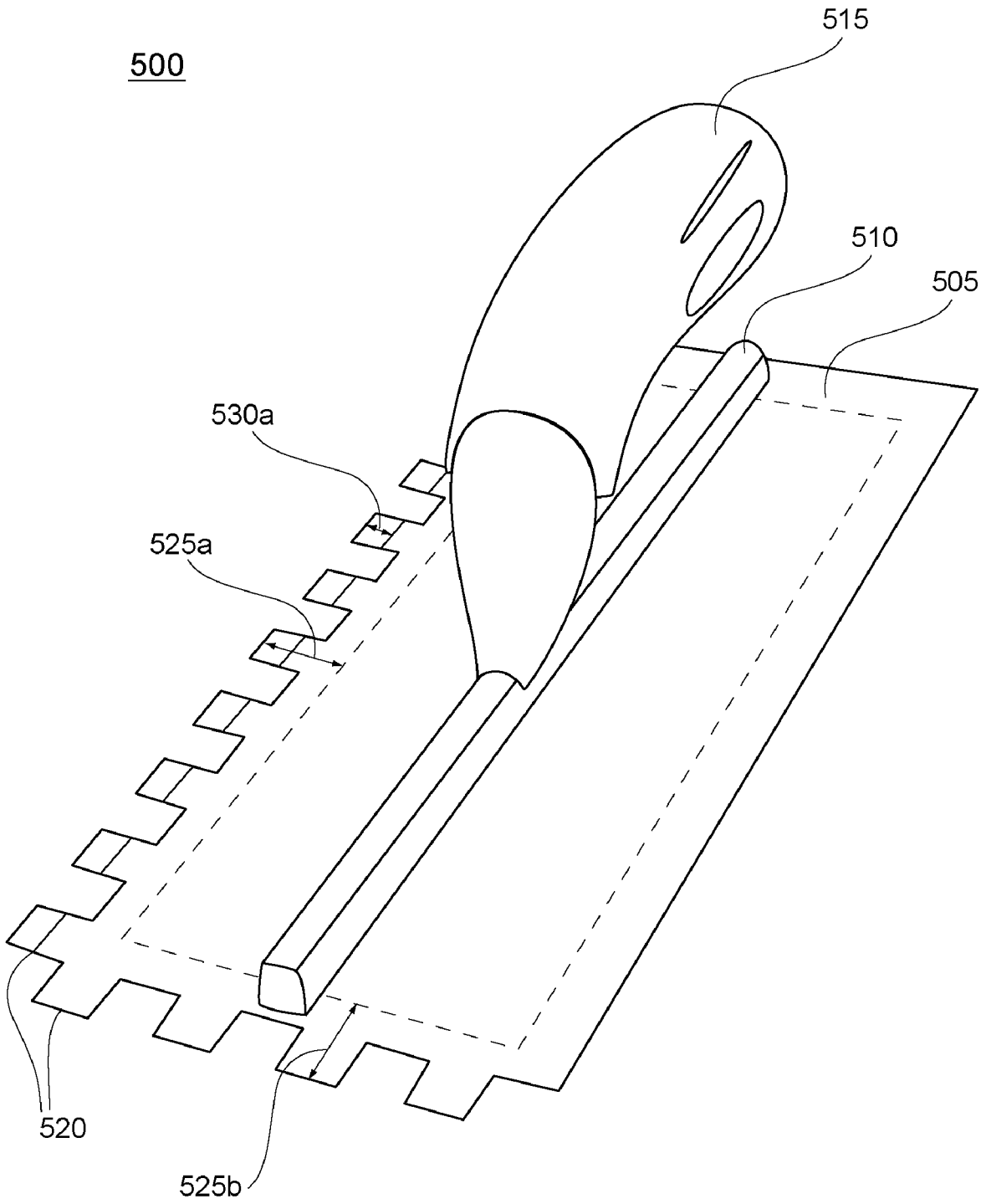
FIG. 5 illustrates a perspective view of a second texturing trowel, according to at least one embodiment of the invention.
Figure 6:
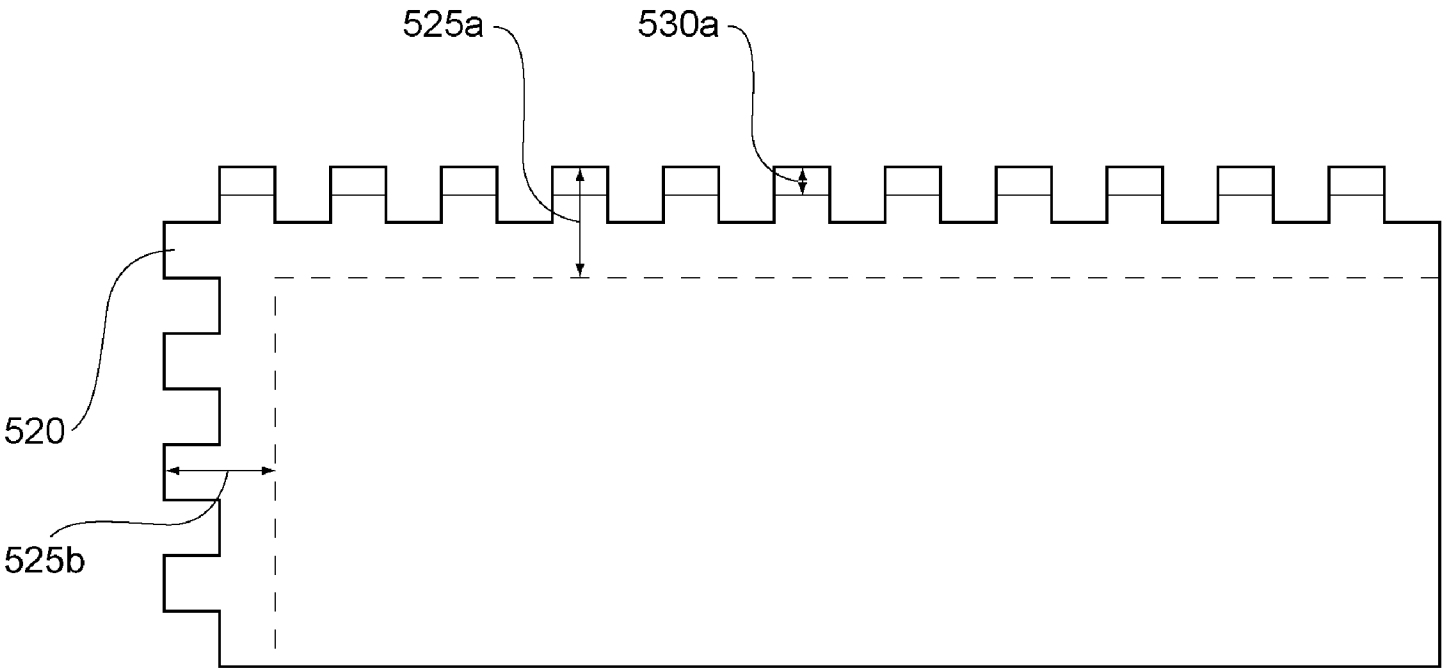
FIG. 6 illustrates a top view of the blade of the texturing trowel shown in FIG. 1, according to at least one embodiment of the invention.

Referring to FIGS. 5 and 6, a perspective view and a top view (without the tang and handle) of a second texturing trowel 500 is provided. The second texturing trowel 500 may have a trowel blade 505 made of a material, for example, a metal. The metal may be, for example, a high carbon steel ranging between AISI 1060 steel and AISI 1095 steel to name a few. In this example, the texturing edge may be in the shape of, for example, a square notch or square teeth 520. Further, the square notch or teeth 520 may be partially heat treated as shown by distance 530*a*, or completely heat treated similar to the embodiments shown in FIGS. 1-3. In this case, the heat treatment 530*a* is shown along only one side or edge of the trowel blade 505, side a. However, it is understood that the heat treatment may be applied to any and all areas of the trowel blade 505. The heat treatment may be performed using, for example, the process described with respect to FIG. 4 or a similar process for hardening the blade 505 material so that it is more durable, strong, and long lasting. As such, the blade 505 may be cleaned along one or more sides to be heat treated as indicated shown by the dotted line area, for example areas 525*a* and/or 525*b*, etc., prior to being heat treated.

Figure 7:
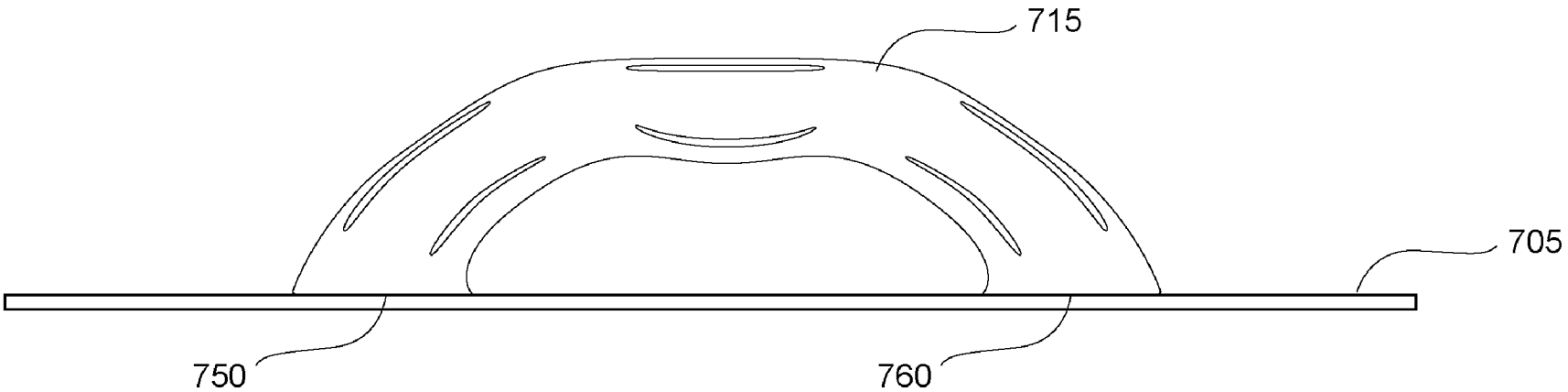
FIG. 7 illustrates a side view of the blade and a handle for a third type of trowel, according to at least one embodiment of the invention.

FIG. 7 illustrates a side view of the blade 705 and a handle 715 for a third trowel, according to at least one embodiment of the invention. In this embodiment, the handle 715 is of a different design having two separate attachment points 750 and 760. The handle 715 may be made of, for example, wood, metal, plastic, rubber, etc. and may be attached to the blade 705 using, for example, screws, molding, adhesive, welding, brazing, etc. The blade 705 may be made of the materials described herein, may have the shape and design as described elsewhere herein, and may be heat treated according to the methods described elsewhere herein.

Figure 8:
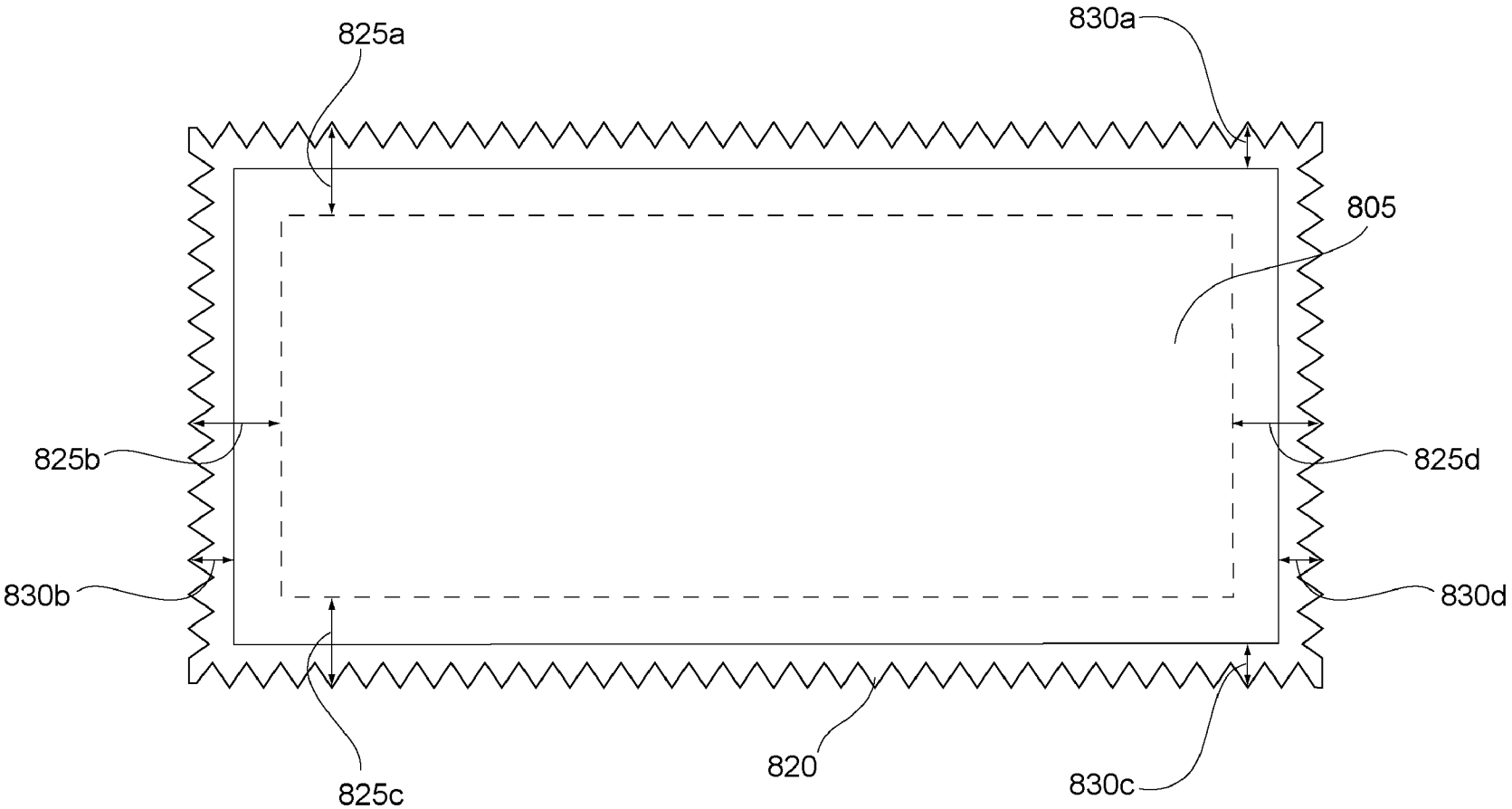
FIG. 8 illustrates the blade of another tool, according to at least one embodiments of the invention.

Referring to FIG. 8, a top view (without the handle and/or tang) of another texturing trowel blade 805 is provided. This texturing trowel blade may be couple to one of a number of handle designs (not shown attached thereto). The trowel blade 805 made of a material, for example, a metal. The metal may be, for example, a high carbon steel ranging between AISI 1060 steel and AISI 1095 steel. In this example, all four texturing edges, a, b, c, and d, may be in the shape of, for example, a V notch or teeth 820. Further, the V notch or teeth 820 may be partially heat treated as shown by, for example, distance 830*a*, a distance more or less than distance 830*a*, or completely heat treated, similar to the embodiments shown and described above. In this case, the heat treatment 830*a*, 830*b*, 830*c* and 830*d* are shown along each of the four sides or edges (a, b, c and d) of the trowel blade 805, side a. However, it is understood that the heat treatment may be applied to any and all of these or other areas of the trowel blade 805. The heat treatment may be performed using, for example, the process described with respect to FIG. 4 or a similar process for hardening the blade 805 material so that it is more durable, strong, and long lasting. As such, the blade 805 may be cleaned along one or more sides to be heat treated as indicated shown by the dotted line area, for example areas 825*a*, 825*b*, 825*c* and/or 825*d*, etc., prior to being heat treated.

Figure 9:
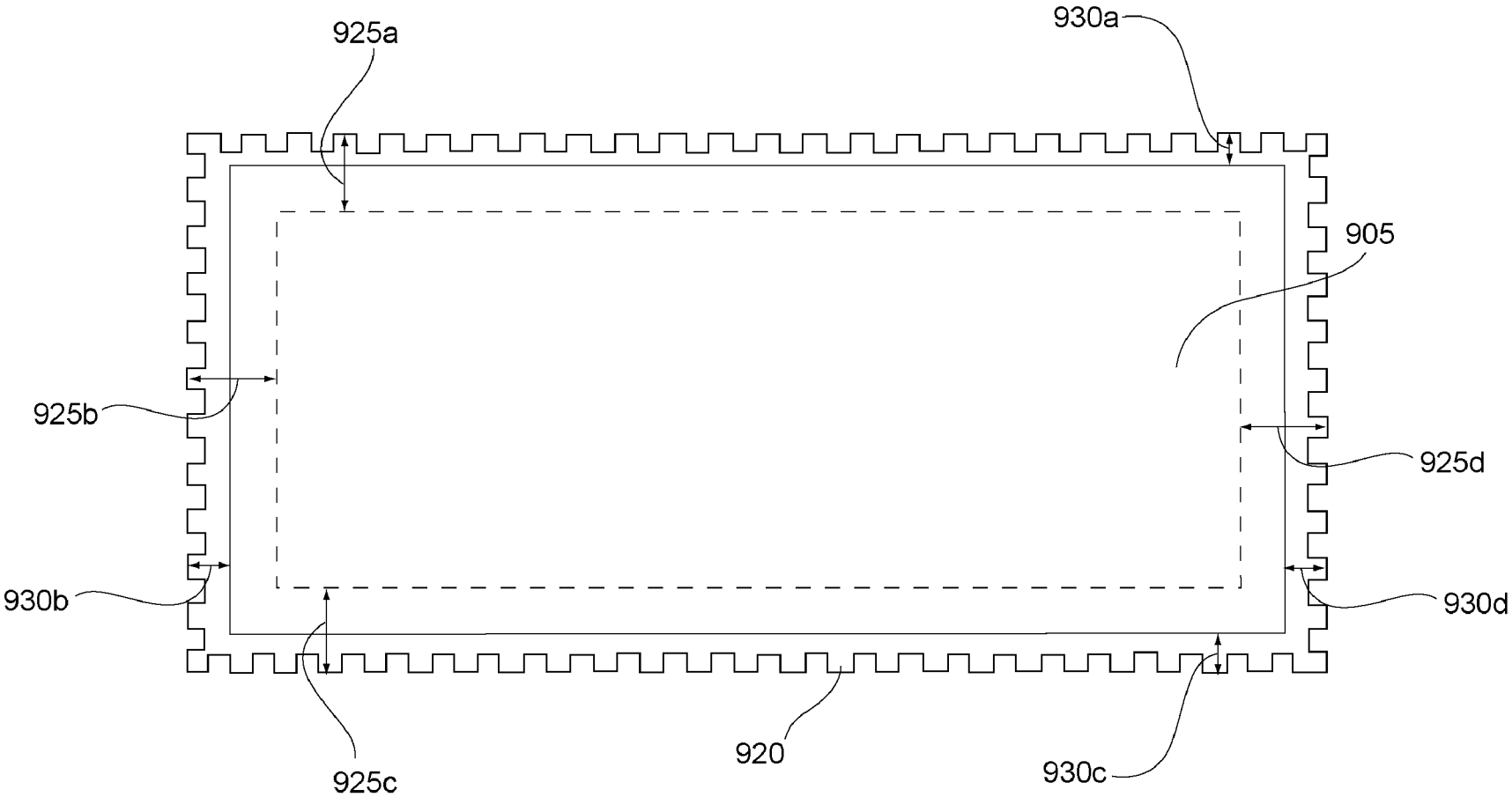
FIG. 9 illustrates the blade of another tool, according to at least one embodiments of the invention.

Referring to FIG. 9, a top view (without the handle and/or tang) of another texturing trowel blade 905 is provided. This texturing trowel blade may be couple to one of a number of handle designs (not shown attached thereto). The trowel blade 905 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch or teeth 920. Of course a rectangular shape may also be used. Further, the square notch or teeth 920 may be partially heat treated as shown by, for example, distance 930*a*, a distance more or less than distance 930*a*, or completely heat treated, similar to the embodiments shown and described above. In this case, the heat treatment 930*a*, 930*b*, 930*c* and 930*d* are shown along each of the four sides or edges (a, b, c and d) of the trowel blade 905. However, it is understood that the heat treatment may be applied to any and all of these or other areas of the trowel blade 905. The heat treatment may be performed using, for example, the process described with respect to FIG. 4 or a similar process for hardening the blade 905 material so that it is more durable, strong, and long lasting. As such, the blade 905 may be cleaned along one or more sides to be heat treated as indicated shown by the dotted line area, for example areas 925*a*, 925*b*, 925*c* and/or 925*d*, etc., prior to being heat treated.

Figure 10:
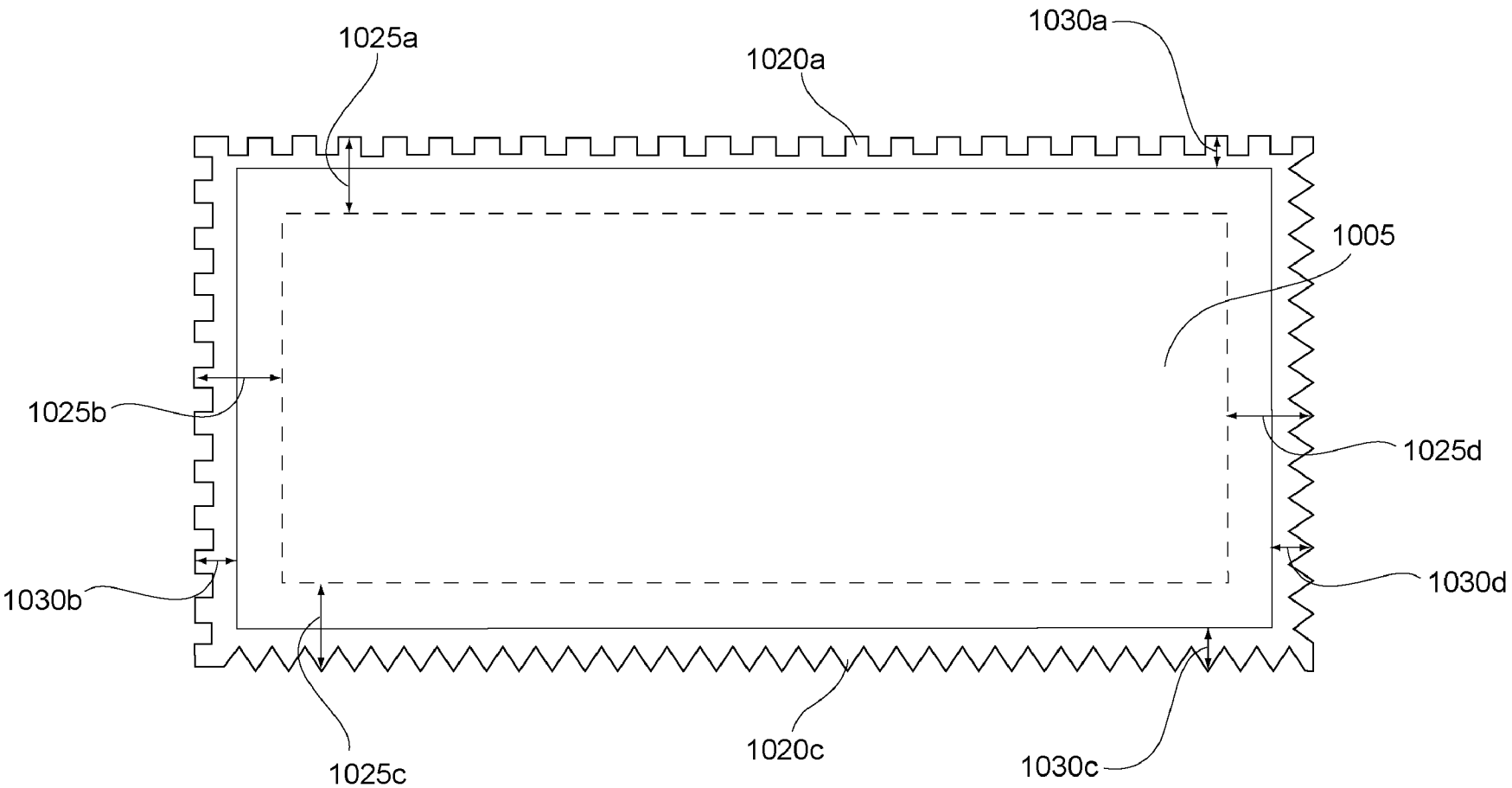
FIG. 10 illustrates the blade of another tool, according to at least one embodiments of the invention.

Referring to FIG. 10, a top view (without the handle and/or tang) of another texturing trowel blade 1005 is provided. This texturing trowel blade may be couple to one of a number of handle designs (not shown attached thereto). The trowel blade 1005 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch or teeth 1020*a* and 1020*b* and a V notch or teeth 1020*c* and 1020*d*. Of course a rectangular shape may also be used. Further, the square notch or teeth 1020*a* and 1020*b* and/or the V notch or teeth 1020*c* and 1020*d*, may be partially heat treated as shown by, for example, distance s1030*a*, 1030*b*, 1030*c*, or 1030*d*, or a distance more or less than distance any of these distances, or completely heat treated, similar to the various embodiments shown and described above. In this case, the heat treatment area(s) 1030*a*, 1030*b*, 1030*c* and 1030*d* are shown along each of the four sides or edges (a, b, c and d) of the trowel blade 1005, side a. However, it is understood that the heat treatment may be applied to any and all of these or other areas of the trowel blade 1005. The heat treatment may be performed using, for example, the process described with respect to FIG. 4 or a similar process for hardening the blade 1005 material so that it is more durable, strong, and long lasting. As such, the blade 1005 may be cleaned along one or more sides to be heat treated as indicated shown by the dotted line area, for example areas 1025*a*, 1025*b*, 1025*c* and/or 1025*d*, etc., prior to being heat treated.

Figure 11:
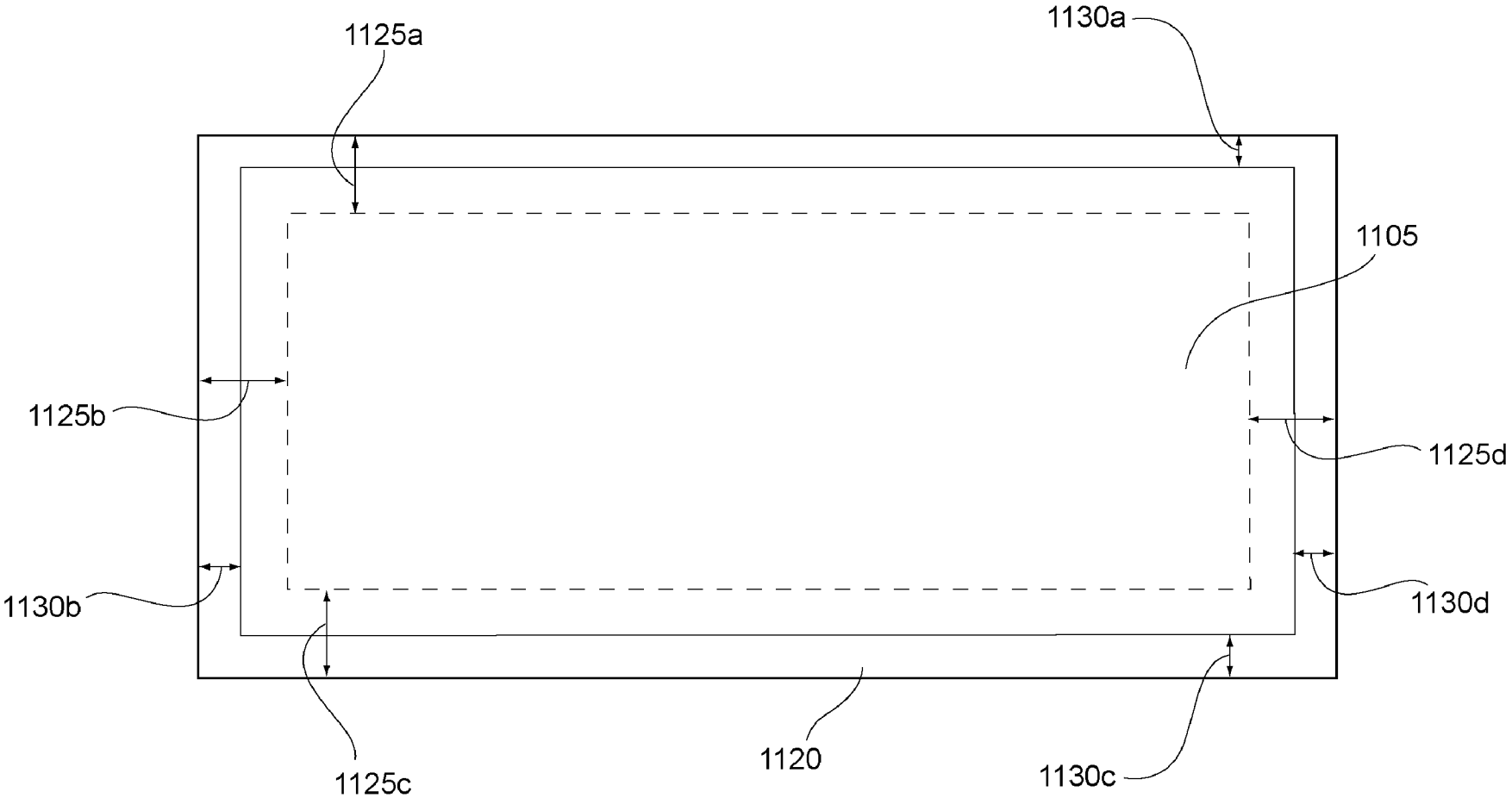
FIG. 11 illustrates the blade of another tool, according to at least one embodiments of the invention.

Referring to FIG. 11, a top view (without the handle and/or tang) of another trowel blade 1105 is provided. This trowel blade 1105 is for a straight edge trowel and that does not typically texture a working surface. Rather, it is meant for smoothing surfaces. However, its straight edges may be heat treated to make them last longer with extensive use on, for example, abrasive work surfaces, and be more durable if dropped so that the straight edge remains straight longer. In any case, the blade 1105 may be couple to one of a number of handle designs (not shown attached thereto). The trowel blade 1105 made of a material, for example, a metal. The metal may be, for example, a high carbon steel such as AISI 1060 steel or AISI 1095 steel, to name a few. In this example, all four of the edges, a, b, c, and d, may be straight and a portion thereof heat treated, as shown by solid lines with a distance of 1130*a*, 1130*b*, 1130*c*, and/or 1130*d*. One or more of these edges may be partially heat treated as shown by, for example, distance 1130*a*, a distance more or less than distance 1130*a*, or completely heat treated, similar to the embodiments shown and described above. In this case, the heat treatment area(s) 1130*a*, 1130*b*, 1130*c* and 1130*d* are shown along each of the four sides or edges (a, b, c and d) of the trowel blade 1105. However, it is understood that the heat treatment may be applied to any and all of these or other areas of the trowel blade 1105, as desired. The heat treatment may be performed using, for example, the process described with respect to FIG. 4 or a similar process for hardening the blade 1105 material so that it is more durable, strong, and long lasting. As such, the blade 1105 may be cleaned along one or more sides to be heat treated as indicated shown by the dotted line area, for example areas 1125*a*, 1125*b*, 1125*c* and/or 1125*d*, etc., prior to being heat treated.

Figure 12:
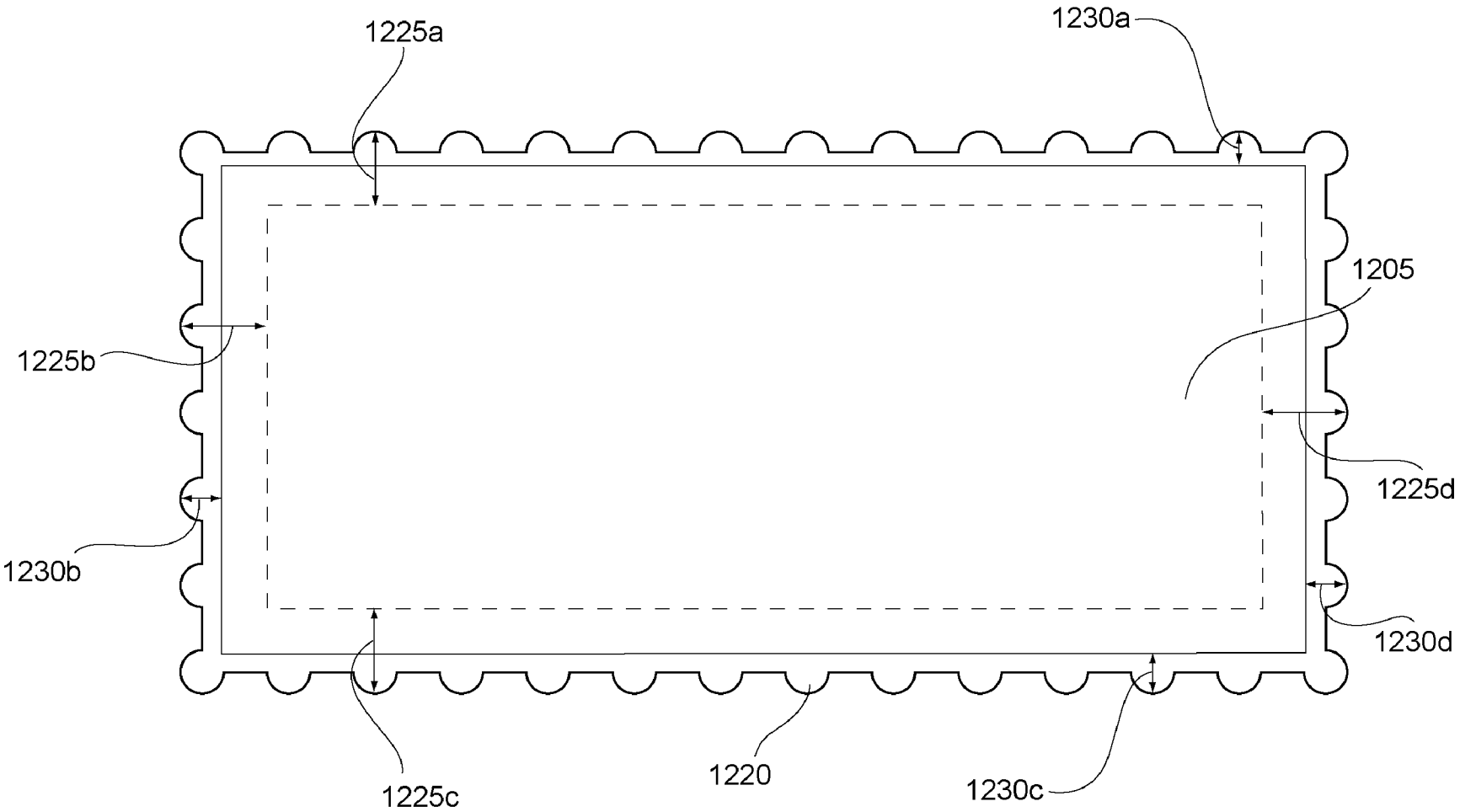
FIG. 12 illustrates the blade of another tool, according to at least one embodiments of the invention.

Referring to FIG. 12, a top view (without the handle and/or tang) of another texturing trowel blade 905 is provided. This texturing trowel blade may be couple to one of a number of handle designs (not shown attached thereto). The trowel blade 1205 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch and rounded teeth 1220. Of course a rounded shape notch may also be used. Further, the square notch and rounded teeth 1220 may be partially heat treated as shown by, for example, distance 1230*a*, a distance more or less than distance 1230*a*, or completely heat treated, similar to the embodiments shown and described above. In this case, the heat treatment 1230*a*, 1230*b*, 1230*c* and 1230*d* are shown along each of the four sides or edges (a, b, c and d) of the trowel blade 1205. However, it is understood that the heat treatment may be applied to any and all of these or other areas of the trowel blade 1205. The heat treatment may be performed using, for example, the process described with respect to FIG. 4 or a similar process for hardening the blade 1205 material so that it is more durable, strong, and long lasting. As such, the blade 1205 may be cleaned along one or more sides to be heat treated as indicated shown by the dotted line area, for example areas 1225*a*, 1225*b*, 1225*c* and/or 1225*d*, etc., prior to being heat treated.

Figure 13:
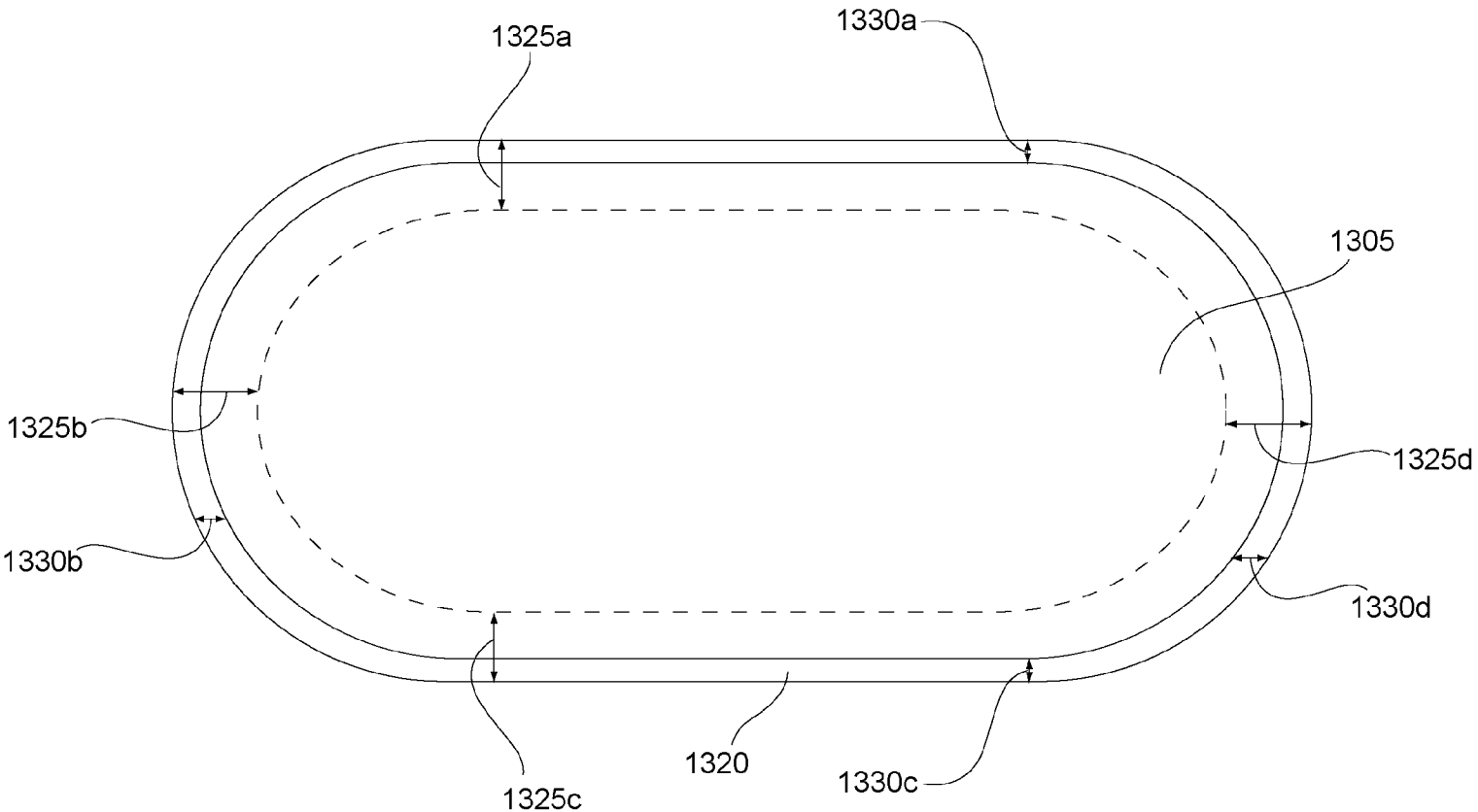
FIG. 13 illustrates the blade of another tool, according to at least one embodiments of the invention.

Referring to FIG. 13, a top view (without the handle and/or tang) of another trowel blade 1305 is provided. This trowel blade 1305 is for a swimming pool trowel having straight edge sides a and c and rounded sides b and d, that does not typically texture a working surface. Rather, it is meant for producing smooth surfaces in, for example, a swimming pool. However, its straight edges (a and c) and rounded edges (b and d) may be heat treated to make them last longer with extensive use on, for example, abrasive work surfaces such as cement, and be more durable if dropped so that the straight edges (a and c) and rounded edges (b and d) remains straight longer. In any case, the blade 1305 may be couple to one of a number of handle designs (not shown attached thereto). The trowel blade 1305 made of a material, for example, a metal. The metal may be, for example, a high carbon steel such as AISI 1060 steel or AISI 1095 steel, to name a few. In this example, all four of the edges, a, b, c, and d, may be straight and a portion thereof heat treated, as shown by solid lines with a distance of 1330*a*, 1330*b*, 1330*c*, and/or 1330*d*. One or more of these edges may be partially heat treated as shown by, for example, distance 1330*a*, a distance more or less than distance 1330*a*, or completely heat treated, similar to the embodiments shown and described above. In this case, the heat treatment area(s) 1330*a*, 1330*b*, 1330*c* and 1330*d* are shown along each of the four sides or edges (a, b, c and d) of the trowel blade 1305. However, it is understood that the heat treatment may be applied to any and all of these or other areas of the trowel blade 1305, as desired. In this case it may be particularly desirable to hear treat edges b and d since they are rounded. The heat treatment may be performed using, for example, the process described with respect to FIG. 4 or a similar process for hardening the blade 1305 material so that it is more durable, strong, and long lasting. As such, the blade 1305 may be cleaned along one or more sides to be heat treated as indicated shown by the dotted line area, for example areas 1325*a*, 1325*b*, 1325*c* and/or 1325*d*, etc., prior to being heat treated.

Figure 14:
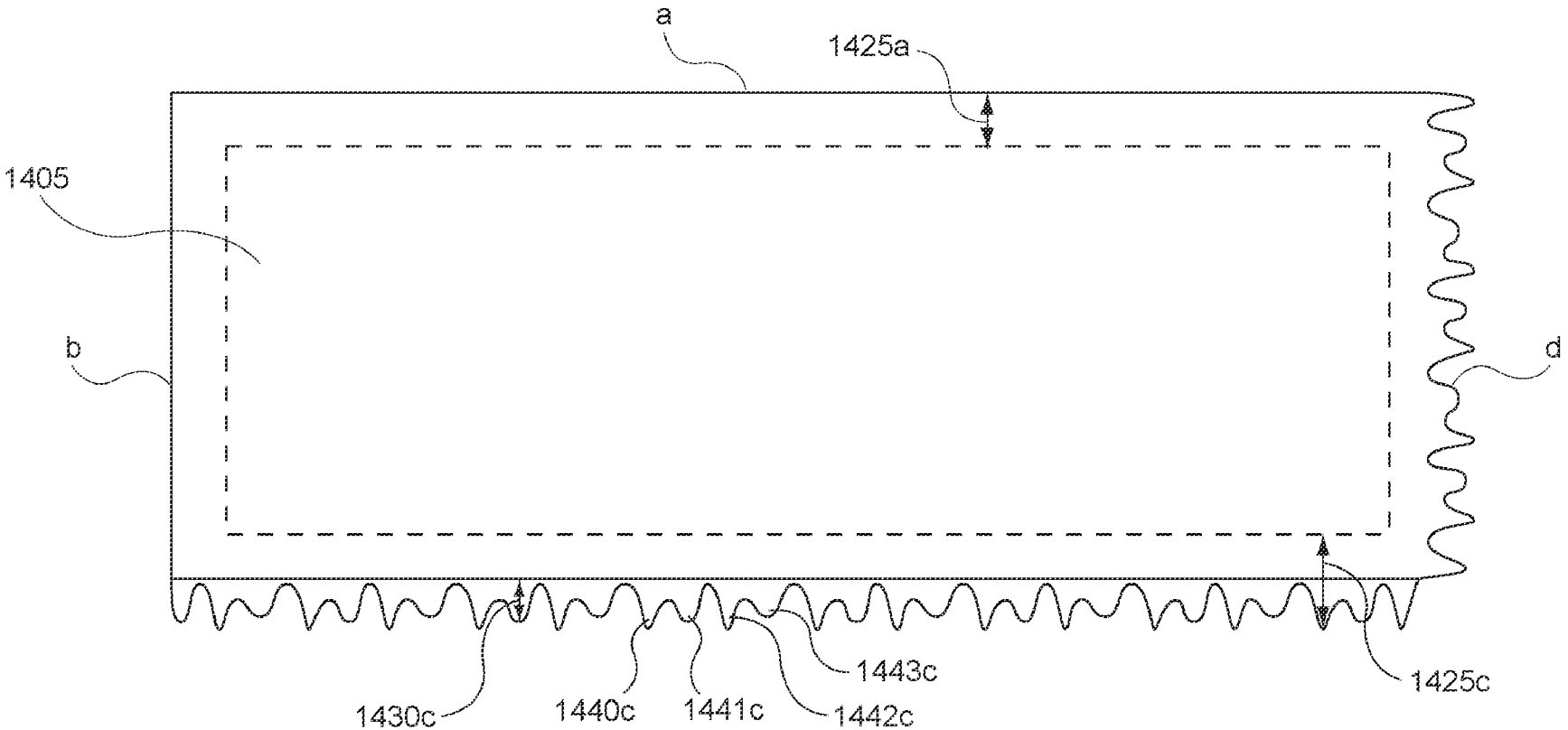
FIG. 14 illustrates the blade of another tool, according to at least one embodiments of the invention.

Referring to FIG. 14, a top view (without the handle and/or tang) of another trowel blade 1405 is provided. This trowel blade 1405 may be a muti-shaped tooth trowel having straight edge sides a and b and textured sides b and d. The textured sides b and d may have a plurality of different shaped teeth, 1440*c*, 1441*c*, 1442*c*, 1443*c*, that may texture a working surface. This texturing trowel 1405 may have a trowel blade 505 made of a material, for example, a metal. The metal may be, for example, a high carbon steel such as AISI 1060 steel or AISI 1095 steel to name a few. In this example, the texturing edge may be in the shape of, for example, a repeating pattern of teeth, for example, four different shaped teeth in series that repeat to form a complete side of texturing teeth, for example sides c and d. Of course the repeating pattern may be of 2, 3, 4, etc. number of teeth. Further, the muti-shaped notches or teeth along side c may be partially heat treated or completely heat treated as shown by distance 1430*c*. In this case, the heat treatment 1430*c* is shown along only one side or edge of the trowel blade 1405, side c. However, it is understood that the heat treatment may be applied to any and all areas of the trowel blade 1405. The heat treatment may be performed using, for example, any of the processes described above, or a similar process, for hardening the blade 1405 material so that it is more durable, strong, and long lasting. As such, the blade 1405 may be cleaned along one or more sides to be heat treated as indicated shown by the dotted line area, for example areas 1425*a* and/or 1425*c*, etc., prior to being heat treated. Although, it would be understood by one skilled in the art that the invention may be applicable to trowels with blades and teeth having any of a number of shapes and combination thereof.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. For example, the heating and cooling process of the present invention for hardening or strengthening blades may also be applied to other tools, for example, putty knifes, paint scrappers, notched margin trowels (V and/or square notches), notched taping knifes, brick trowels, pointing trowels, margin trowels, trowels with non-rectangular shaped blades, etc, where long term abrasive use may disadvantageously alter the original shape of the tool and/or tool blade. Further, other methods may be used for increasing the durability of the tools working edges (e.g., teeth, etc.), such as attaching (e.g., welding, adhesive, etc.) a more durable material to the tool blade as the work surface. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes

What is claimed is:

1. A building construction tool for applying and removing building material, and made of a long lasting design with a fixed blade-to-handle construction comprising:

a substantially planar blade made of a metallic base material and having only selected portion(s) of the blade that are made harder than the base material;

a separate handle connecting mechanism that is at least in part made of metal and includes a tang connected to an inner surface of the substantially planar blade that is not a working surface of the blade, is not on the periphery of the blade, and has not been made harder, the handle connecting mechanism being preassembled in connection to the blade in a permanent manner so that the blade is not easily removed from the handle connecting mechanism or replaced from the building construction tool; and a handle that is connected and secured to the handle connecting mechanism, whereby the blade is made more durable so as to have a longer useful life with improved durability, strength and/or resistance against wear and the blade to handle connection is made more durable.

2. The building construction tool of claim 1, the selected portion(s) of the blade has been made more durable by being heat treated.

3. The building construction tool of claim 2, wherein at least one working surface of the blade is heat treated.

4. The building construction tool of claim 3, wherein the heat treating includes induction heating.

5. The building construction tool of claim 3, wherein the base material is a high carbon steel.

6. The building construction tool of claim 1, wherein the working surface of the blade is an edge surface of the blade.

7. The building construction tool of claim 1, wherein the selected portion(s) is on at least one perimeter surface(s) of the blade and the handle is permanently connected to the blade during manufacturing assembly of the building construction tool.

8. A building construction tool comprising:

a substantially planar blade made of a metallic base material and having only selected portion(s) of the blade that are made harder than the base material; and a separate handle connecting mechanism that is at least in part made of metal, the handle connecting mechanism comprised of a tang permanently connected to a face of the blade and extending along a length thereof, the tang being secured to the blade in a portion thereof that has not been made harder and the tang being within and spaced from the periphery of the blade; and a handle secured to the handle connecting mechanism, whereby the blade is made more durable so as to have a longer useful life with improved durability, strength and/or resistance against wear and the blade to handle connection is made more durable.

9. The building construction tool of claim 8, wherein the selected portion(s) of the blade has been made more durable by being heat treated.

10. The building construction tool of claim 9, wherein at least one working surface of the blade is heat treated.

11. The building construction tool of claim 10, wherein the heat treating includes induction heating.

12. The building construction tool of claim 10, wherein the metal is a high carbon steel.

13. The building construction tool of claim 8, wherein the working surface of the blade is an edge surface of the blade.

14. The building construction tool of claim 8, wherein the selected portion(s) is on at least one perimeter surface(s) of the blade and the handle is permanently connected to the blade during manufacturing assembly of the building construction tool.

15. A building construction tool for applying and removing building material, and made of a long lasting design with a fixed blade-to-handle construction, comprising:

a blade made of a base material that includes metal and having only selected portion(s) of the blade that are made harder than the base material;

a handle connecting mechanism that is at least in part made of metal, the handle connecting mechanism comprised of a tang permanently connected to a flat inner surface of the blade that is not a working surface of the blade, is not on the periphery of the blade, and has not been made harder; and a handle that is connected to the blade using the handle connecting mechanism by connecting a portion of the blade made of the base material that has not been made harder with the metal part of the handle connecting mechanism and in a manner that the blade is not easily removed from the handle connecting mechanism or replaced from the building construction tool, whereby the blade is made more durable so as to have a longer useful life with improved durability, strength and/or resistance against wear and the blade to handle connection is made more durable; and whereby the building construction tool is constructed in a shape and style particular for applying and removing construction material using at least the only selected portion(s) of the blade that are made harder than the base material, so that the building construction tool has a long lasting blade and may be used repeatedly over longer lengths of time without replacing the building construction tool.

16. The a building construction tool of claim 15, wherein the material is a metal and the selected portion(s) of the blade has been made more durable by being heat treated.

17. The building construction tool of claim 16, wherein at least one working surface of the blade is heat treated.

18. The building construction tool of claim 17, wherein the working surface of the blade is an edge surface of the blade.

19. The building construction tool of claim 17, wherein the metal is a high carbon steel and the heat treating includes induction heating.

20. The building construction tool of claim 15, wherein the base material is a metal, the selected portion(s) is on at least one perimeter surface(s) of the blade, and the handle is permanently connected to the blade during manufacturing assembly of the building construction tool.

* * * * *